US007936982B2

(12) United States Patent
Milli

(10) Patent No.: US 7,936,982 B2
(45) Date of Patent: May 3, 2011

(54) HEATED SPRAY PAINTING SYSTEM

(75) Inventor: Ottavio Milli, Grosseto (IT)

(73) Assignee: Eurosider S.A.S. di Milli Ottavio & C., Grosseto (IT)

( * ) Notice: Subject to any disclaimer, the term of this patent is extended or adjusted under 35 U.S.C. 154(b) by 249 days.

(21) Appl. No.: 11/720,007

(22) PCT Filed: Nov. 24, 2005

(86) PCT No.: PCT/IB2005/003531

§ 371 (c)(1), (2), (4) Date: May 23, 2007

(87) PCT Pub. No.: WO2006/056864

PCT Pub. Date: Jun. 1, 2006

(65) Prior Publication Data

US 2008/0128530 A1 Jun. 5, 2008

(30) Foreign Application Priority Data

Nov. 24, 2004 (IT) ..... BO2004A0729

(51) Int. Cl.
*F24H 1/18* (2006.01)

(52) U.S. Cl. ..... 392/449; 392/465; 392/472

(58) Field of Classification Search ..... 392/449, 392/459

See application file for complete search history.

(56) References Cited

U.S. PATENT DOCUMENTS

| | | | | | |
|---|---|---|---|---|---|
| 2,148,986 | A | * | 2/1939 | Hoyt | 239/75 |
| 2,366,150 | A | | 12/1944 | Yount | |
| 2,378,184 | A | | 6/1945 | Carlson | |
| 2,576,558 | A | * | 11/1951 | Bede | 392/495 |
| 2,793,279 | A | * | 5/1957 | Kaiser | 392/496 |
| 2,833,909 | A | * | 5/1958 | Levey | 392/472 |
| 2,942,787 | A | * | 6/1960 | Bok et al. | 239/124 |
| 3,096,426 | A | * | 7/1963 | Axelson | 392/495 |
| 3,336,463 | A | * | 8/1967 | Johnson | 392/481 |
| 3,584,194 | A | * | 6/1971 | Kautz et al. | 392/484 |
| 3,835,294 | A | * | 9/1974 | Krohn et al. | 392/484 |
| 4,034,916 | A | * | 7/1977 | Forsberg | 239/373 |
| 4,621,187 | A | * | 11/1986 | Petro, Jr. | 392/414 |
| 4,667,084 | A | * | 5/1987 | Regge | 392/495 |
| 4,684,786 | A | * | 8/1987 | Mann et al. | 392/441 |
| 4,964,569 | A | * | 10/1990 | Stevens | 239/13 |
| 5,214,740 | A | * | 5/1993 | Carroll | 392/481 |
| 5,240,181 | A | * | 8/1993 | Uribe | 239/135 |
| 5,265,801 | A | * | 11/1993 | Larson | 239/11 |
| 5,478,014 | A | * | 12/1995 | Hynds | 239/135 |
| 5,863,613 | A | | 1/1999 | Emch | |
| 5,974,227 | A | * | 10/1999 | Schave | 392/478 |
| 6,115,542 | A | * | 9/2000 | Nir | 392/449 |
| 6,647,204 | B1 | * | 11/2003 | Hutchinson | 392/491 |

* cited by examiner

*Primary Examiner* — Thor S Campbell
(74) *Attorney, Agent, or Firm* — Pearne & Gordon LLP

(57) ABSTRACT

A system and device for spray painting using a flow of pressurised carrier fluid comprises a central source of the carrier fluid and one or more local elements for heating the fluid close to the point of use.

7 Claims, 2 Drawing Sheets

HEATED SPRAY PAINTING SYSTEM

TECHNICAL FIELD

The present invention relates to a spray painting system, beginning with a carrier fluid consisting of compressed air, modified nitrogen-rich air or another suitable fluid.

BACKGROUND ART

It is known that in the painting sector in general and in particular for spray painting, the paint is mixed with a carrier fluid commonly consisting of compressed air but also modified nitrogen-rich air, and that the drying times for the coats of paint applied are often excessively long partly due to the humidity present in the fluid used as the carrier and/or in the painting environment and absorbed by the carrier fluid and by the components to be painted.

The level of humidity is also increased by the expansion of the fluid, when the distance between the pressurised source and the user device is particularly long, for example more than one metre.

To reduce drying times at present the use of both hot dried air and further measures such as the use of volatile solvents are required.

In particular, the length of the paint drying time is a problem felt in water-based painting systems, increasingly used due to their low environmental impact and greater safety, but which at the same time use water as a solvent, necessitating longer drying times.

This disadvantage is particularly felt where the distance between the apparatus which produces the carrier fluid and the point of use is great, the consequence being that any heating of the fluid at the source is lost and does not provide effects useful for its use.

DISCLOSURE OF THE INVENTION

Therefore the need is strongly felt for a device which provides the spray painting system with a hot flow irrespective of the distance between the source and the user device and therefore a pressurised hot carrier fluid (for example dried air or nitrogen) able to drastically reduce the drying times of the paint applied.

Another aim of the invention is to offer a painting system in which the temperature of the carrier fluid is maintained at or brought to the desired temperature even when considerable distances separate the carrier fluid feed and the point (or points) of use, for example in large painting systems equipped with a plurality of ovens or painting stations.

Accordingly, the present invention provides a painting system and a heating device in accordance with the claims herein.

A first advantage is that the drying time is cut from the current 15-40 minutes to times which vary from one minute to 5 minutes with the system disclosed, particularly in the case of spray painting with water- or solvent-based paints, irrespective of the distribution of the painting points relative to the source of the carrier fluid, and also irrespective of the availability of a source of carrier fluid that is already hot.

BRIEF DESCRIPTION OF THE DRAWINGS

The technical features of the invention, in accordance with the afore-mentioned aims, are clearly indicated in the claims herein and the advantages of the invention are more evident in the detailed description which follows, with reference to the accompanying drawings, which illustrate a preferred embodiment without limiting the scope of the invention, in which:

DETAILED DESCRIPTION OF THE PREFERRED EMBODIMENTS OF THE INVENTION

Figure 1:
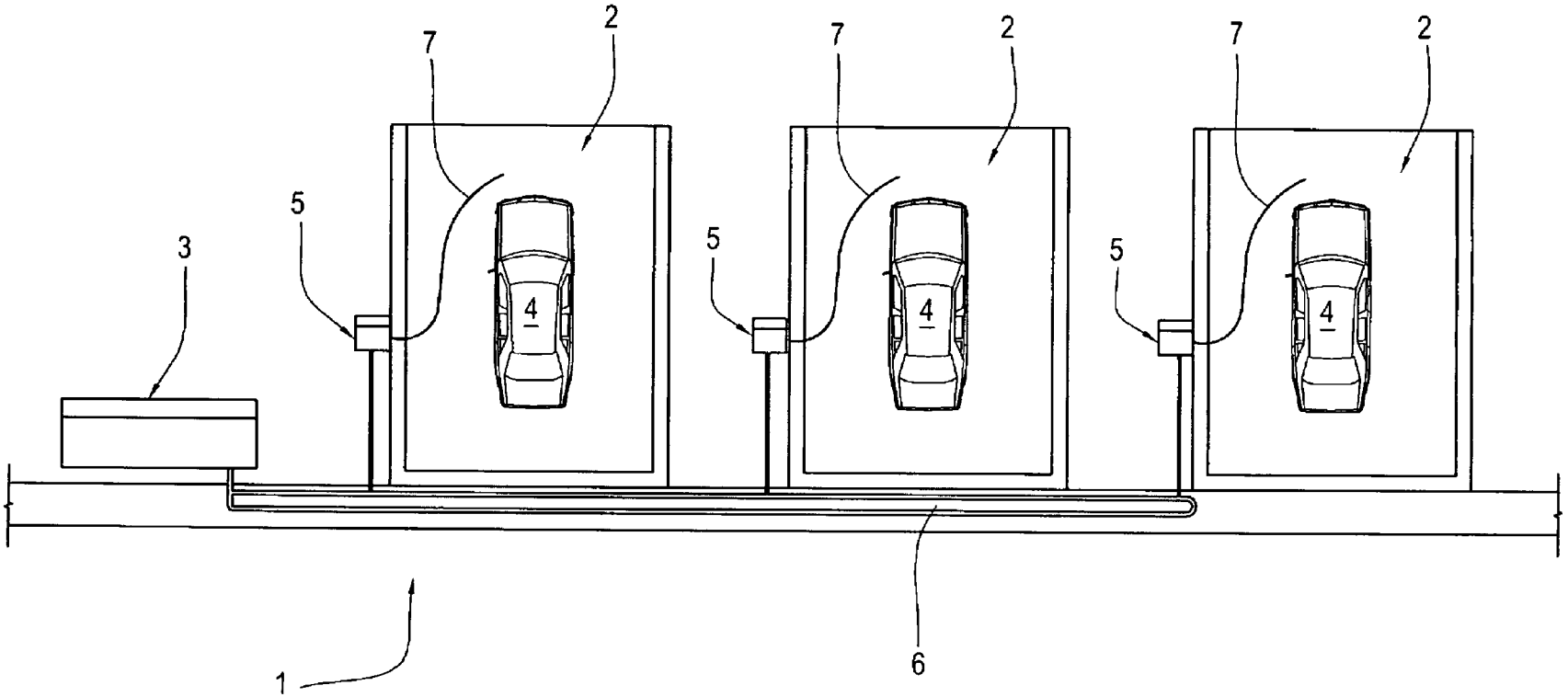
FIG. 1 is a top view of a layout of a painting system in accordance with the invention.
Figure 2:
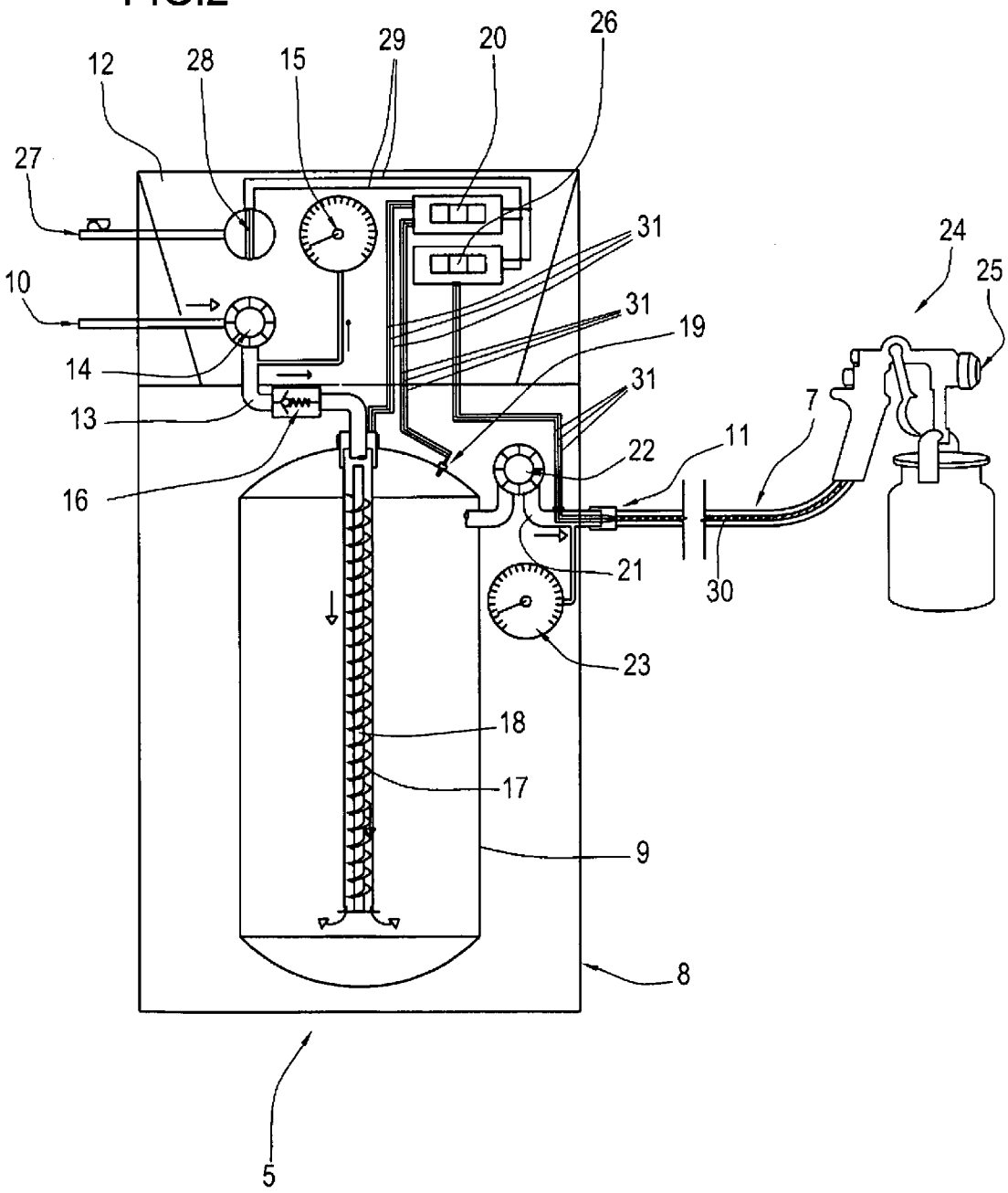
FIG. 2 illustrates a heating device for spray painting in accordance with the invention.

FIGS. 1 and 2 are schematic illustrations of a painting system and a heater in accordance with the invention.

With reference to FIG. 1, a painting system 1 is described having a plurality of local painting stations 2 and a feed 3 of carrier fluid for use in spray painting an object, for example motor cars 4.

According to the invention, attached to each station 2 there is a device 5 for heating the carrier fluid, individually connected to the feed 3 by a distribution unit 6, preferably ring-shaped, so as to make the pressure at each heater 5 uniform.

Each heater 5 may also have a flexible tube 7 at its outlet, preferably being equipped with heating means 30, positioned inside or outside at least one portion of the tube.

In the layout in FIG. 1, there are three stations 2 and the same number of heaters 5 attached to them, but it shall be understood that the number of stations in the system, like the number of feeds 3 and heaters 5 attached to one or more stations may vary according to requirements.

FIG. 2 illustrates a preferred embodiment of a heater 5 for the carrier fluid which can be used with the system 1.

In the example described, the heater 5 comprises a containment box 8 in which there are integrated a carrier fluid pressurised tank 9 (optional), a fluid inlet 10, a heated fluid outlet 11, and a control panel 12 for the most significant operating parameters.

From the inlet 10, the pressurised carrier fluid is introduced into the tank 9, when present, through a pipe 13 along which there are arranged one after another a pressure regulator 14, a manometer 15 for regulating fluid infeed, and a non-return valve 16 which prevents hot fluid from flowing back towards the regulator 14.

Downstream of the non-return valve 16, the pipe 13 introduces the fluid into a tube 17 located in the tank 9 and equipped with an internal electric heating element 18 controlled by a temperature sensor 19 (for example a thermocouple) and a thermostat 20.

Advantageously, the heating element 18 is in the form of a helical finning which allows a high level of heat exchange with the fluid in transit, but it shall be understood that different geometries are possible both for the heating element 18 and for the tube 17.

From the tank 9, the fluid reaches the outlet 11 through a pipe 21 along which there are arranged one after another a regulator 22 and a manometer 23 for controlling the tank outlet pressure.

The outlet 11 is preferably located a long way from the outlet of the heated tube 17 so that the fluid comes out at a mean temperature, avoiding harmful temperature peaks during spraying.

From the tank 9 outlet, the fluid is brought to the spray gun 24 by the flexible tube 7 in turn equipped with a temperature sensor 25 (for example a thermocouple) located close to the gun 24 and connected to a thermostat 26.

The panel 12 also has an electrical power supply 27 which through a switch 28 and wires 29 powers the tank 9 and tube 15 electric heating elements with the respective thermostats and a distribution of wires 31 for powering and controlling the heating elements 18/30 and the relative sensors 19/25.

The system and heater illustrated in FIGS. 1, 2 can be used in particular in combination with a carrier fluid consisting of air and nitrogen-rich air, preferably obtained using separation membranes. However it shall be understood that a different carrier fluid may be used, for example consisting of compressed air, dry compressed or even untreated air, still achieving advantageous effects in painting.

The invention described has evident industrial applications. It may be modified and adapted without thereby departing from the scope of the inventive concept. Moreover, details of the invention may be substituted by technically equivalent elements.

The invention claimed is:

1. A heater for pressurised carrier fluid for spray painting, comprising: an inlet (10) for a flow of pressurised carrier fluid, adjustable heating means (18) for the pressurised carrier fluid, a tank (9) for accumulating the heated fluid operatively integrated with the heating means, an outlet (11) for the fluid destined for painting, and a pressure regulator for adjusting a pressure of the pressurised carrier fluid adjacent to at least one of the inlet (10) and the outlet (11), and in which the tank (9) fluid outlet (11) is connected to a tube (7) equipped with means (30) for heating the flow of carrier fluid, and in which the heated tube (7) has a first connection to a pressurised carrier fluid feed and a second connection to a spray painting gun (24), also having heating means (30) located along at least one portion of its length, the heating means (30) being located inside the tube (7), in contact with the carrier fluid.

2. The heater according to claim 1, in which the heating means (18) are located inside the tank (9).

3. The heater according to claim 1, in which the heating means comprise a heating element with a helical geometry (18) located inside a tube (17) for the passage of the carrier fluid into the tank (9).

4. The heater according to claim 1, in which the tube heating means (30) are controlled by a temperature sensor (25) located at the tube (7) fluid outlet.

5. The heater according to claim 1, comprising a containment box (8) integrated with the tank (9) and the heating means, and having a control panel (12) at least for a pressure value of the pressurised carrier fluid at the inlet and outlet of the tank, a temperature of the pressurised carrier fluid in the tank and a temperature of the fluid at a tube outlet.

6. The heater according to claim 1, in which the heating means (30) are located outside the tube (7).

7. A heater for pressurised carrier fluid for spray painting, comprising: an inlet (10) for a flow of pressurised carrier fluid, a heater (18) for heating the pressurised carrier fluid, a tank (9) for accumulating the heated fluid operatively integrated with the heating means, a conduit (17) at least partially enclosing the heater (18) and extending into the tank (9), the conduit (17) comprising an outlet for discharging the pressurised carrier fluid exposed to the heater into the tank, and an outlet (11) for discharging the pressurised carrier fluid from the tank (9) to a destination to be mixed with paint for painting, wherein the outlet (11) is provided to the tank (9) at a distant location away from the outlet of the conduit (17) to promote a generally-constant temperature of the pressurised fluid discharged from the tank (9) through the outlet (11).

* * * * *